US010465369B2

(12) United States Patent
Kashirajima et al.

(10) Patent No.: US 10,465,369 B2
(45) Date of Patent: Nov. 5, 2019

(54) FLUSH TOILET

(71) Applicant: TOTO LTD., Kitakyushu-shi, Fukuoka (JP)

(72) Inventors: Shu Kashirajima, Kitakyushu (JP); Masaaki Momoe, Kitakyushu (JP); Yuuki Shinohara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/710,943

(22) Filed: Sep. 21, 2017

(65) Prior Publication Data

US 2018/0087256 A1 Mar. 29, 2018

(30) Foreign Application Priority Data

Sep. 23, 2016 (JP) ..... 2016-185931

(51) Int. Cl.
*E03D 11/06* (2006.01)
*E03D 11/08* (2006.01)

(52) U.S. Cl.
CPC ..... *E03D 11/06* (2013.01); *E03D 11/08* (2013.01); *E03D 2201/40* (2013.01)

(58) Field of Classification Search
CPC ..... E03D 11/08; E03D 11/13; E03D 2201/40
USPC ..... 4/428
See application file for complete search history.

(56) References Cited

U.S. PATENT DOCUMENTS 6,145,138 A * 11/2000 Nakamura ..... E03D 11/02 4/420
7,661,153 B2 * 2/2010 Nakamura ..... E03D 11/08 4/420
8,640,272 B2 * 2/2014 Morita ..... E03D 11/08 4/420

(Continued)

FOREIGN PATENT DOCUMENTS

CN 201099902 Y 8/2008
CN 102953421 A 3/2013

(Continued)

OTHER PUBLICATIONS

An Office Action; "Notification of Reasons for Refusal," mailed by the Japanese Patent Office dated Sep. 3, 2018, which corresponds to Japanese Patent Application No. 2016-185931 and is related to U.S. Appl. No. 15/710,943; with English language translation.

(Continued)

*Primary Examiner* — Erin Deery
*Assistant Examiner* — Nicholas A Ros
(74) *Attorney, Agent, or Firm* — Studebaker & Brackett PC

(57) ABSTRACT

A flush toilet includes a bowl including a rim formed on the top edge of a bowl-shaped waste receiving surface; and a rim spout portion disposed on the rim for forming a circulating flow by spouting flush water into the bowl. The bowl further includes a shelf between the top edge of the waste receiving surface and the bottom end of the rim, and a connecting surface for connecting the outside edge of this shelf and the bottom end of the rim with a curved surface. The connecting (Continued)

surface is arranged so that the curvature radius of its curved surface in the vertical direction is essentially constant from the bowl front portion across both the left and right sides, and so that its position rises toward the left and right sides from the front portion of the bowl.

2 Claims, 14 Drawing Sheets

(56) References Cited

U.S. PATENT DOCUMENTS

| | | | | |
|---|---|---|---|---|
| 2013/0047328 | A1 | 2/2013 | Yamasaki et al. | |
| 2013/0047330 | A1* | 2/2013 | Yamasaki | E03D 11/13 4/431 |
| 2015/0082531 | A1 | 3/2015 | Kashirajima et al. | |
| 2015/0197928 | A1* | 7/2015 | McHale | E03D 11/02 4/423 |

FOREIGN PATENT DOCUMENTS

| | | | |
|---|---|---|---|
| CN | 104514267 | A | 4/2015 |
| JP | 2016-501326 | A | 1/2016 |
| JP | 2016-041879 | A | 3/2016 |
| JP | 2016-041881 | A | 3/2016 |

OTHER PUBLICATIONS

An Office Action mailed by the State Intellectual Property Office of the People's Republic of China dated Apr. 22, 2019, which corresponds to Chinese Patent Application No. 201710646717.7 and is related to U.S. Appl. No. 15/710,943.

* cited by examiner

FLUSH TOILET

TECHNICAL FIELD

The present invention relates to a flush toilet, and more particularly to a flush toilet configured to discharge waste by flushing the flush toilet with flush water supplied from a flush water source.

BACKGROUND

Known conventional flush toilets in which waste is discharged by flushing with flush water supplied from a flush water source have included those such as set forth in Patent Document 1 (Japanese Patent Unexamined Publication No. 2016-41879), for example, wherein in a connecting surface for connecting a rising wall portion forming the inside perimeter surface of the rim on a toilet main unit bowl, in order to limit the accumulation of urine at the connecting surface around the center portion in the left-right direction of the front area of the bowl where urine is particularly prone to strike, the vertical curvature radius of the connecting portion is maximal at the left-right center of the bowl front area, and becomes gradually smaller toward the left and right sides.

However, in the conventional flush toilet of the above-described Patent Document 1, the inside perimeter side of the bowl rim has an edgeless shape. This presents the problem that flush water spouted into and circulating in the bowl, as well as urine, can splash outside the bowl.

Also, in the above-described conventional flush toilet, there is no boundary or shelf, etc. between the vertical wall area inside the bowl and the circulating area in which flush water circulates. This raises the risk that, with the change in curvature radius in the vertical direction of the connecting surface, in particular, circulating water will expand on the vertical wall portion side, or that circulating water will drop on the bowl side without completing a full revolution, so that flushing is not sufficiently completed.

SUMMARY

The present invention was therefore undertaken to resolve the above-described problems with the conventional art, and has the object of providing a flush toilet in which flush water flowing over the bowl shelf is less prone to expand on the rim side, flush water can be smoothly circulated, and urine can be prevented from running up the inside perimeter surface of the rim and splashing outside the bowl.

To solve the above-described problems, the present invention is a flush toilet configured to discharge waste by flushing the flush toilet with flush water supplied from a flush water source, the flush toilet comprising: a bowl which includes a rim formed at a top edge of the bowl, a bowl-shaped waste receiving surface, and a shelf formed between the bowl-shaped waste receiving surface and the rim; a discharge path configured to discharge waste, the discharge path being connected to a bottom of the bowl; and a rim spout portion disposed on the rim, the rim spout porting being configured to spout the flush water onto the shelf in the bowl so as to form a circulating flow; wherein the shelf is formed between a top edge of the waste receiving surface and a bottom end of the rim and in a circumferential direction from the rim spout portion, the shelf being configured to guide the flush water spouted from the rim spout portion in the circumferential direction, the bowl further includes a connecting surface configured to connect an outside edge of the shelf and the bottom end of the rim by a curved surface; and the connecting surface is configured that a curvature radius of the curved surface in the vertical direction is essentially constant from a front portion of the bowl across both left and right sides of the bowl, and a position of the connecting surface rises toward the left and right sides of the bowl from the front portion of the bowl.

According to the invention thus constituted, flush water spouted from the rim spout portion is guided in the circumferential direction by flowing over the shelf, thereby forming a circulating flow. At this point, the connecting surface connecting the outside edge of the bowl shelf to the bottom end of the rim by a curved surface is arranged so that curvature radius in the vertical direction of that curved surface is essentially constant from the front portion across both the left and right sides. At the same time, it is arranged at positions which rise as the position moves from the bowl front portion to the left and right sides. A connection is thus made between the outside edge of the bowl shelf and the bottom end of the rim with a relatively small curvature radius from the bowl front portion across the left and right sides.

Hence flush water flowing over the bowl shelf is less prone to expand on the rim side, and flush water can be made to circulate smoothly. Flush water can thus be constrained from splashing outside the bowl. Or, flush water can be constrained from dropping onto the inside of the bowl without sufficiently circulating.

At the front of the bowl, where urine is prone to strike, for example, the urine can be prevented from running up the inside perimeter surface of the rim from the connecting surface and splashing outside the bowl even if the urine strikes the connecting surface of the bowl, etc.

In the present invention, preferably, the rim includes a rising wall surface configured that an inside circumference surface of the rim rises, a height of the rising wall surface is set to become higher as a position of the rising wall surface moves from the left and right sides of the bowl to the front of the bowl.

According to the invention thus constituted, flush water flowing over the bowl shelf is even less prone to expand on the rim side, and flush water can be made to circulate more smoothly.

Also, because the height of the rising wall surface is arranged to become higher at the front of the bowl where urine is more prone to strike, urine can be effectively constrained from running up the rising wall surface at the bowl front and splashing outside the bowl.

In the present invention, preferably, the rising wall surface includes an upper rising wall surface and a lower rising wall surface, the upper rising wall surface defining an upper region of the inside circumference surface of the rim, the lower rising wall surface defining a lower region of the inside circumference, and a curvature radius in a vertical direction of the lower rising wall surface is set to diminish as a position of the lower rising wall surface moves from the left and right side of the bowl to the front of the bowl.

According to the invention thus constituted, flush water flowing over the bowl shelf is even less prone to expand on the rim side, and flush water can be made to circulate more smoothly.

In particular, because the curvature radius in the vertical direction of the lower rising wall surface of the rising wall surface is arranged to diminish at the front of the bowl, where urine is prone to strike, urine can be effectively constrained from running up the rising wall surface at the bowl front and splashing outside the bowl.

In the present invention, preferably, the shelf includes a sloped surface configured to slope downward from an outside of an interior of the bowl toward an inside of the interior of the bowl, and a slope angle of the sloped surface is set to increase as a position of the sloped surface moves from the left and right sides of the bowl toward the front of the bowl.

According to the invention thus constituted, flush water flowing over the bowl shelf is even less prone to expand on the rim side, and flush water can be made to circulate more smoothly.

Also, the slope angle of the shelf sloped surface is arranged to increase at the front of the bowl where urine is particularly prone to strike. Urine can thus be made to flow down the inside of the bowl without accumulating on the shelf, therefore urine can be even more effectively constrained from running up the rising wall surface at the bowl front and splashing outside the bowl.

In the present invention, preferably, the bowl further includes an urine contact surface between the shelf and the bottom end of the rim; and the connecting surface includes: a first connecting surface and a second connecting surface, the first connecting surface being configured to connect the bottom end of the rim and a top end of the urine contact surface by a curved surface, and the second connecting surface being configured to connect the bottom end of the urine contact surface to the outside edge of the shelf by a curved surface; wherein each curvature radius in a vertical direction of each curved surface of the first connecting surface and the second connecting surface is set to be essentially constant from the front portion of the bowl across both the left and right sides of the bowl; and the urine contact surface is formed in a predetermined circumferential direction region which includes the front portion of the bowl, and the urine contact surface is configured to disappear in a left and right side regions relative to the predetermined circumferential direction region.

According to the invention thus constituted, flush water flowing over the bowl shelf is not prone to expand on the rim side, and flush water can be made to circulate smoothly. Along with this, the formation of a urine contact surface in a predetermined circumferential direction region which includes the front portion of the bowl, where urine is particularly prone to strike, enables urine to be effectively constrained from running up the rim inside circumference surface from the front portion of the bowl and splashing outside the bowl.

With the flush toilet of the invention, flush water flowing over the bowl shelf has difficulty expanding on the rim side, and flush water can be made to smoothly circulate, so that urine is constrained from running up the inside circumference surface of the rim and splashing outside the bowl.

DETAILED DESCRIPTION

Next, referring to FIGS. 1-7, a flush toilet according to a first embodiment of the invention is explained as follows.

Figure 1:
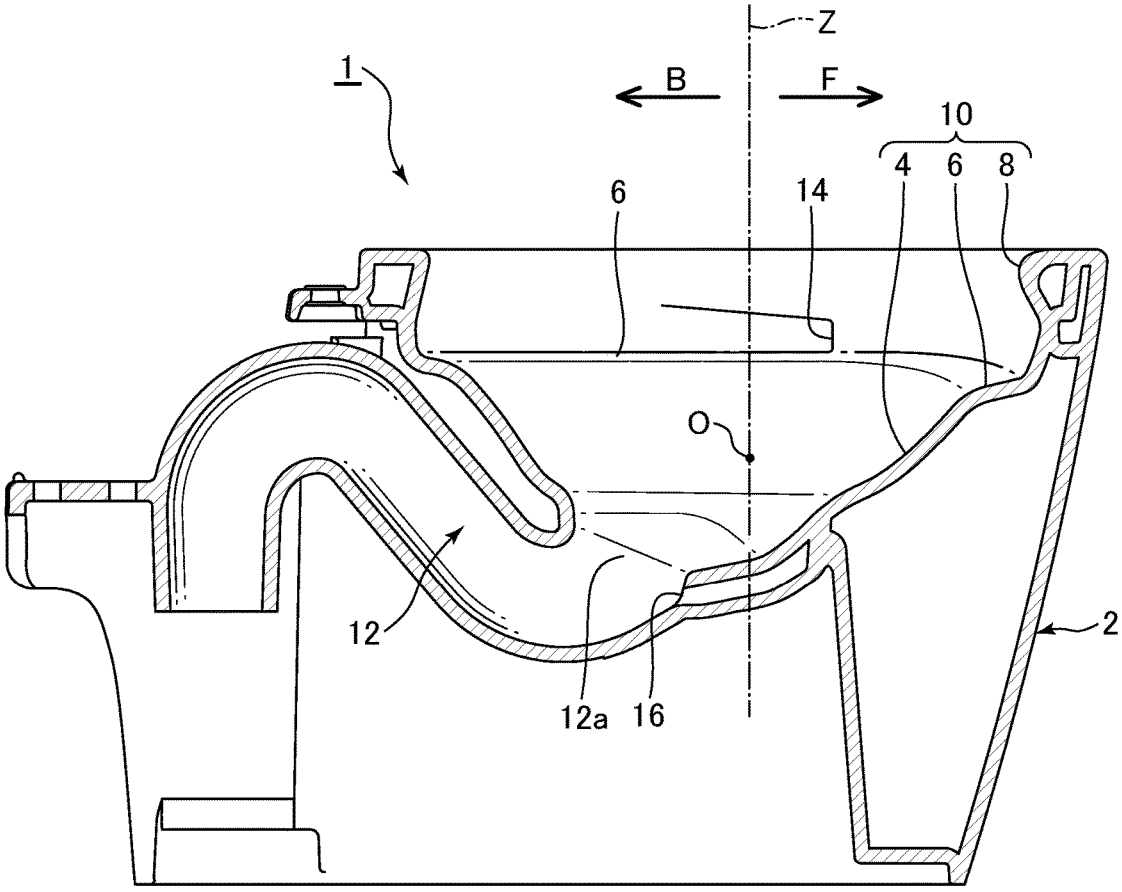
FIG. 1 is a center cross section of the main unit of a flush toilet according to a first embodiment of the invention.
Figure 2:
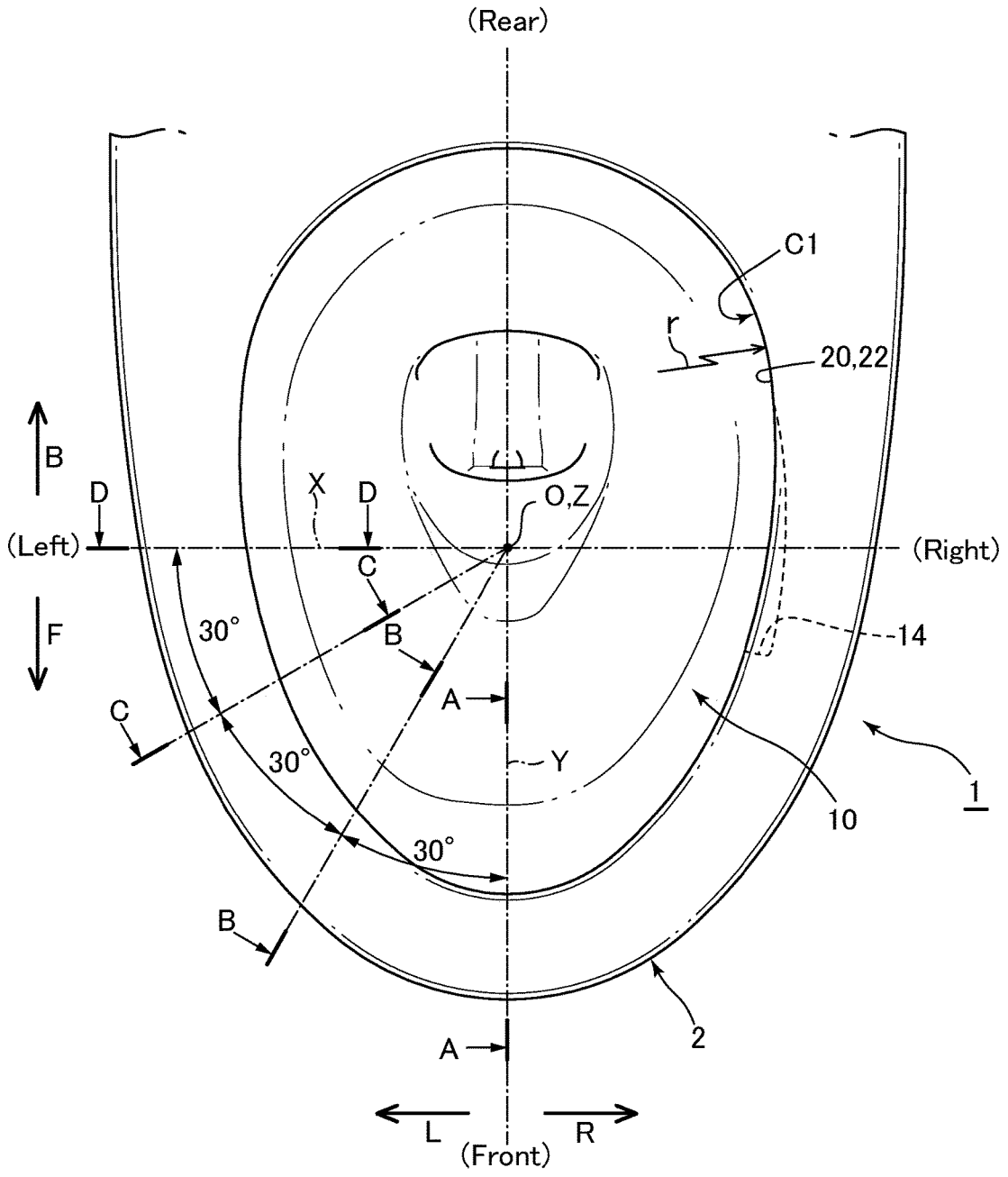
FIG. 2 is a plan view of the main unit of the flush toilet according to the first embodiment of the invention.

First, FIG. 1 is a center cross section of the main unit of a flush toilet according to a first embodiment of the invention. FIG. 2 is a plan view of the main unit of the flush toilet according to the first embodiment of the invention. Furthermore, FIG. 3 is a perspective view seen diagonally from the rear of the flush toilet main unit of the flush toilet according to the first embodiment of the invention.

Figure 3:
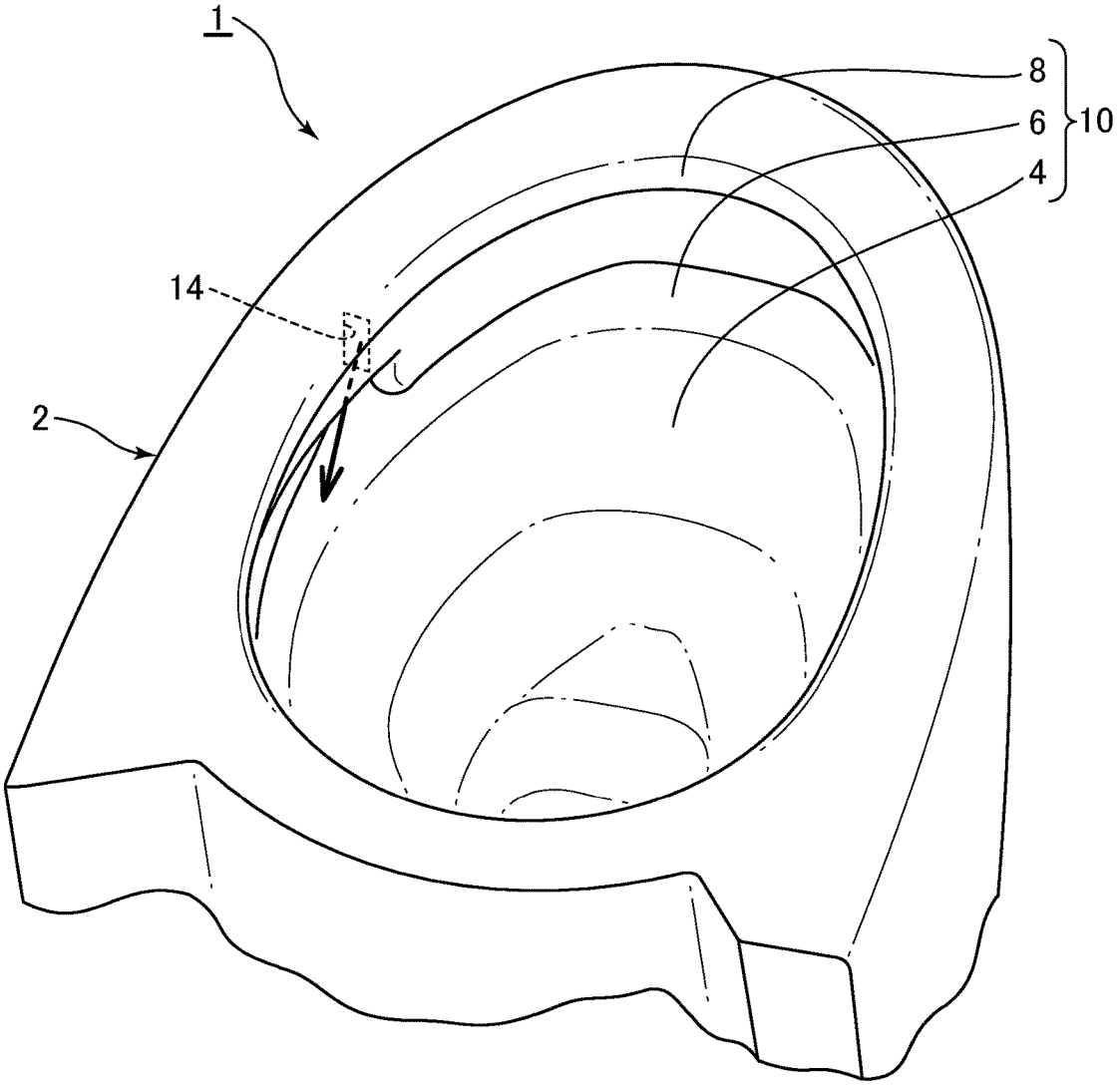
FIG. 3 is a perspective view seen diagonally from the rear of the flush toilet main unit of the flush toilet according to the first embodiment of the invention.

As shown in FIGS. 1-3, the flush toilet 1 according to the first embodiment of the invention includes a ceramic toilet body 2.

In the embodied flush toilet 1 shown here in FIGS. 1-3, a toilet seat and toilet lid (not shown) are provided on the top surface of the toilet main body 2. A sanitary flush portion for washing a user's private parts, and functional portions such as the water supply system involved in the water supply function to the toilet main unit 2, are installed on the rear side of this toilet seat and toilet lid. However, these are not illustrated, and an explanation thereof is here omitted.

As shown in FIGS. 1-3, the toilet main unit 2 includes a bowl made up of a bowl-shaped waste receiving surface 4, a shelf 6, and a rim 8. The shelf 6 is formed on the top edge of the waste receiving surface 4. The rim 8 is formed so as to rise from the top end of this shelf 6.

In addition, as shown in FIG. 1, the toilet main unit 2 includes a discharge trap pipe 12. The inlet 12*a* of this discharge trap pipe 12 is connected to the bottom of the bowl 10, and serves as a discharge path for discharging waste in the bowl 10.

Here, in the flush toilet 1 according to the first embodiment of the present invention shown in FIGS. 1 and 2, the center axis in the horizontal left-right direction of the bowl 10 of the toilet main unit 2 as seen in plan view is indicated by an "X," the center axis in the horizontal front-back direction thereof is indicated by a "Y," and the center axis in the vertical direction passing through the center O of the bowl 10 is indicated by a "Z."

As shown in FIG. 2, the front, rear, left, and right directions of the flush toilet 1 are respectively indicated as "front," "rear," "left," and "right."

And, as shown in FIGS. 1 and 2, a "front side region F" and "rear side region B" are respectively defined for the front and rear sides relative to the center O of the bowl 10 of the flush toilet 1, the horizontal left-right direction center axis X, and the vertical direction center axis Z.

In addition, as shown in FIG. 2, a "left side region L" and "right side region R" are respectively defined for the left and right sides, as seen from the front, of the center O of the bowl 10 of the flush toilet 1 and the horizontal front-back direction center axis Y.

Next, as shown in FIGS. 1-3, the rim 8 on either the left or right inside the front region F of the bowl 10, i.e., on the inside perimeter side of the rim 8 in the right side region R within the front region F of the bowl 10 as seen from the front of the toilet main unit 2, a single rim spout port 14 is formed as part of the rim spout portion, and forms a circulating flow by spouting flush water rearward into the bowl 10.

Also, a rim conduit (not shown) on the upstream side of the rim spout port 14 is formed inside the rim 8. Also, the upstream side of this rim conduit (not shown) is connected via a water utility pipe (not shown) or the like to a water utility (not shown) or the like serving as flush water source.

In addition, the shelf 6 of the bowl 10 is formed in the circumferential direction on the downstream side from the rim spout port 14, and flush water spouted (rim spouted) rearward from the rim spout port 14 is guided along the shelf 6 in the circumferential direction.

In addition, as shown in FIG. 1, a jet spout port 16 is formed at the bottom portion of the bowl 10. This jet spout port 16 is directed toward the inlet 12*a* of the discharge trap pipe 12. In this way, spouting (jet spouting) from a water supply functional portion (not shown) is also effected from this jet spout port 16.

Also, in the flush toilet 1 according to the present embodiment, rim spouting by the rim spout port 14 is performed using water utility supply pressure. A "hybrid" form of flush toilet is also explained, in which flush water is supplied into a reservoir tank (not shown) by controlling a pressurizing pump (not shown) for jet spouting by the jet spout port 16. Without limit to this form, however, the invention may also be applied to other forms. A form is also acceptable in which jet spouting by the jet spout port 16 is omitted.

Next, referring to FIGS. 1-7, the part from the top edge of the waste receiving surface 4 of the bowl 10 to the rim 8 in a flush toilet 1 according to a first embodiment of the invention is explained in detail as follows.

Figure 4:
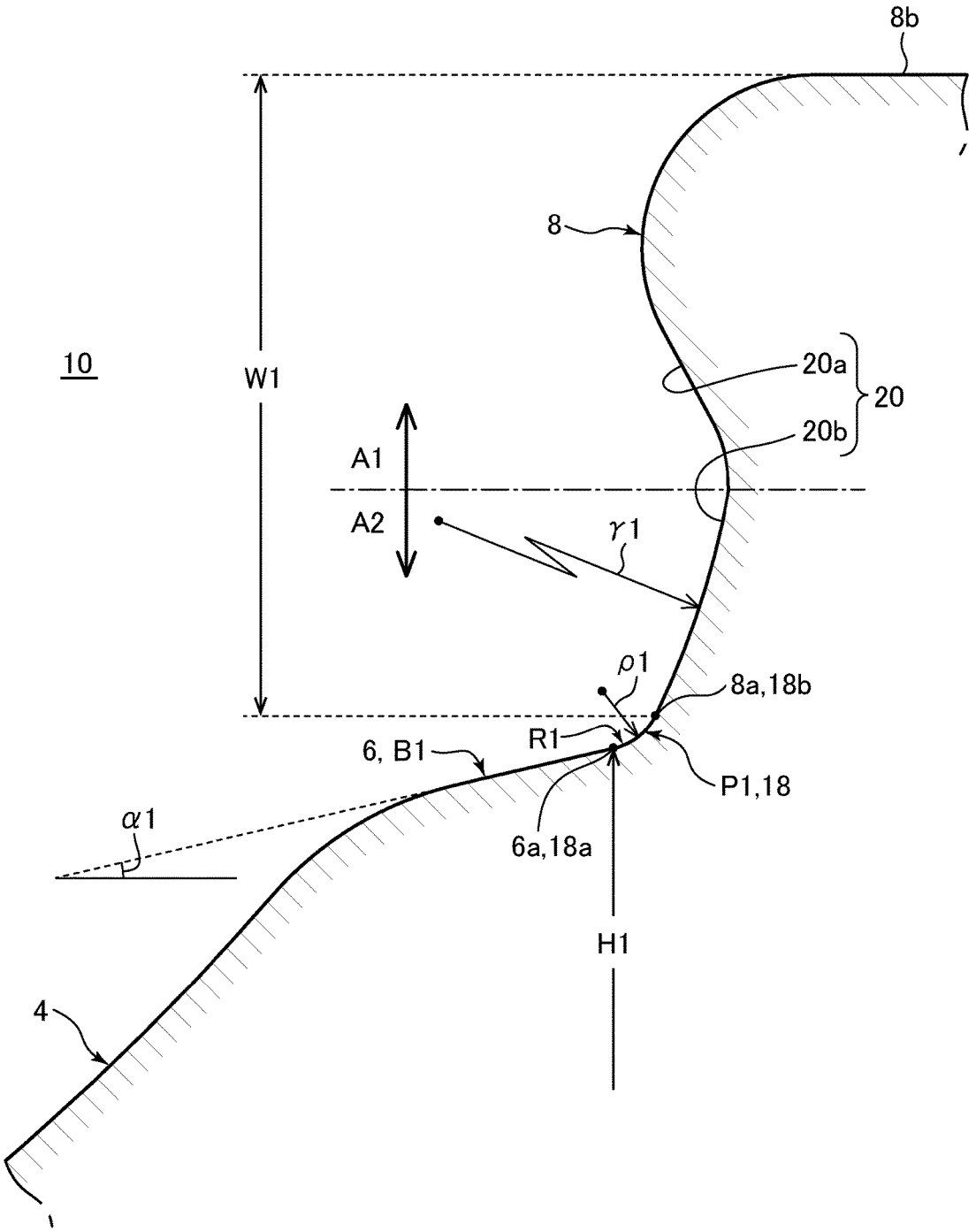
FIG. 4 is a cross section through line A-A in FIG. 2.

First, FIG. 4 is a cross section through line A-A in FIG. 2, and is a cross section of the part from the top edge of the waste receiving surface 4 to the rim 8 of the bowl 10.

Figure 5:
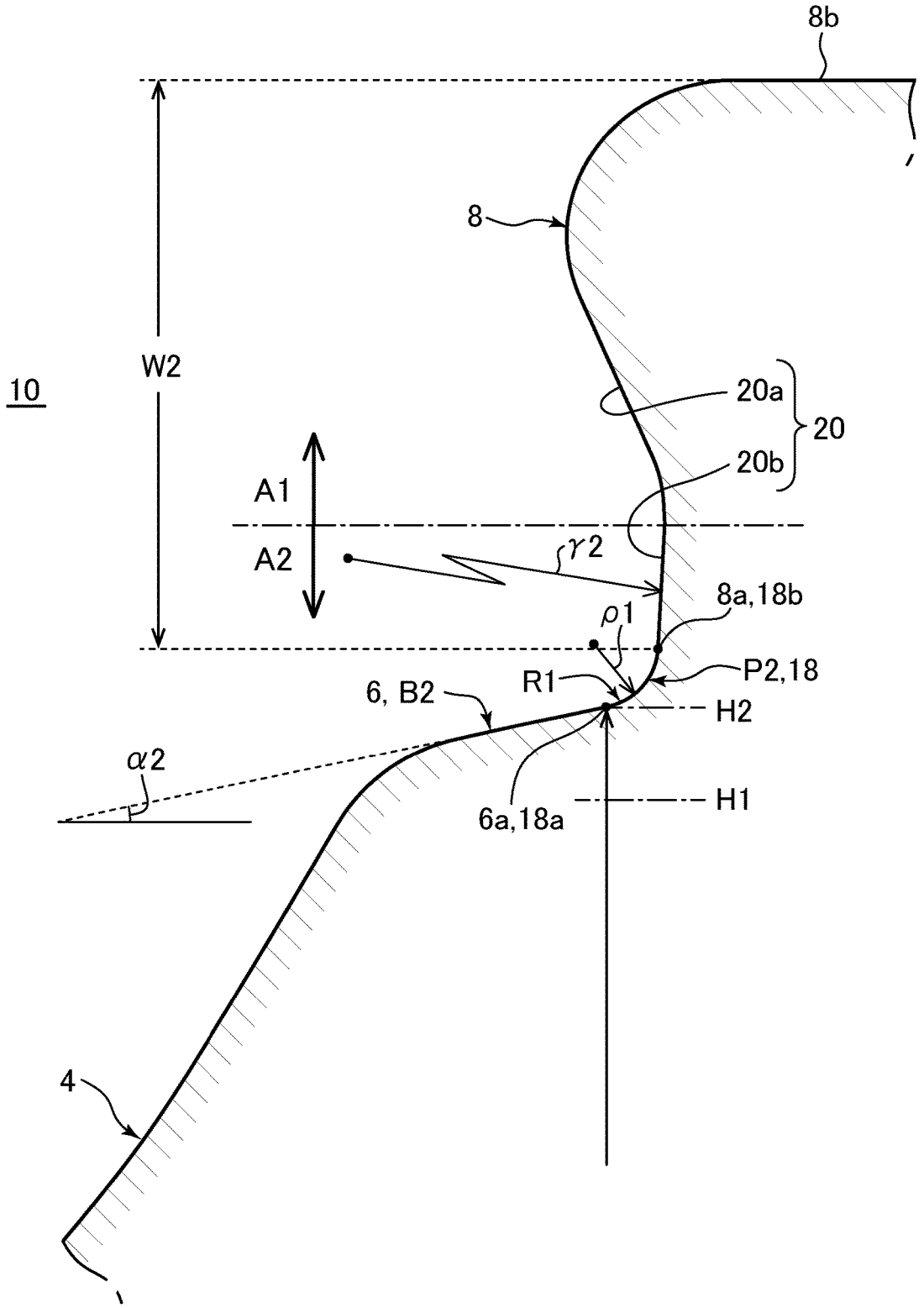
FIG. 5 is a cross section through line B-B in FIG. 2.

Next, FIG. 5 is a cross section through line B-B in FIG. 2, and is a cross section of the front left region of the bowl 10 which is offset by 30° in the right circumferential direction about a center O of the bowl 10 from the cross section through line A-A in the toilet main unit 2 seen in plan view as shown in FIG. 2.

Figure 6:
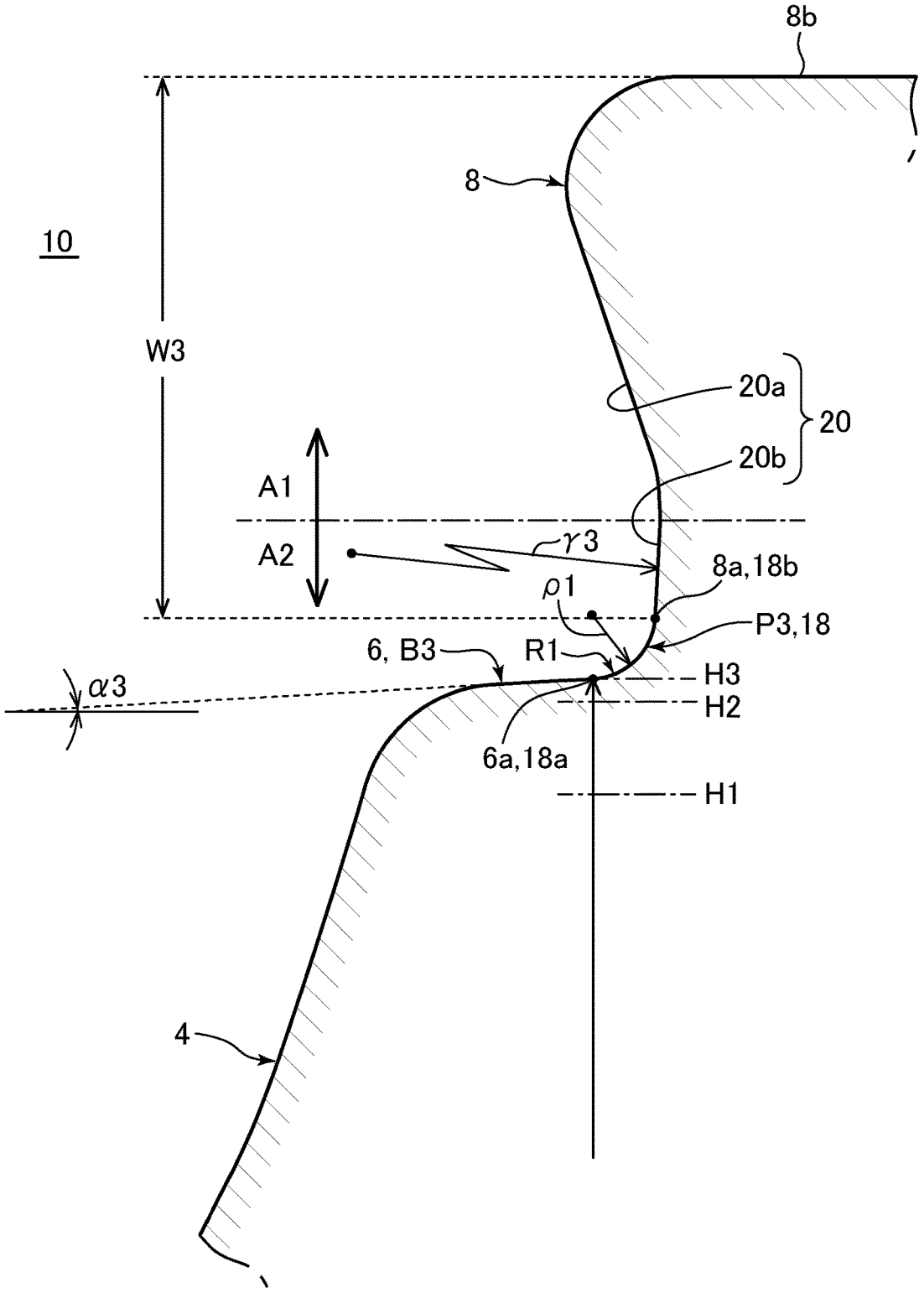
FIG. 6 is a cross section through line C-C in FIG. 2.

Also, FIG. 6 is a cross section through line C-C in FIG. 2, and is a cross section of the front left region of the bowl 10 which is offset by 60° in the right circumferential direction about a center O of the bowl 10 from the cross section through line A-A in the toilet main unit 2 seen in plan view as shown in FIG. 2.

Figure 7:
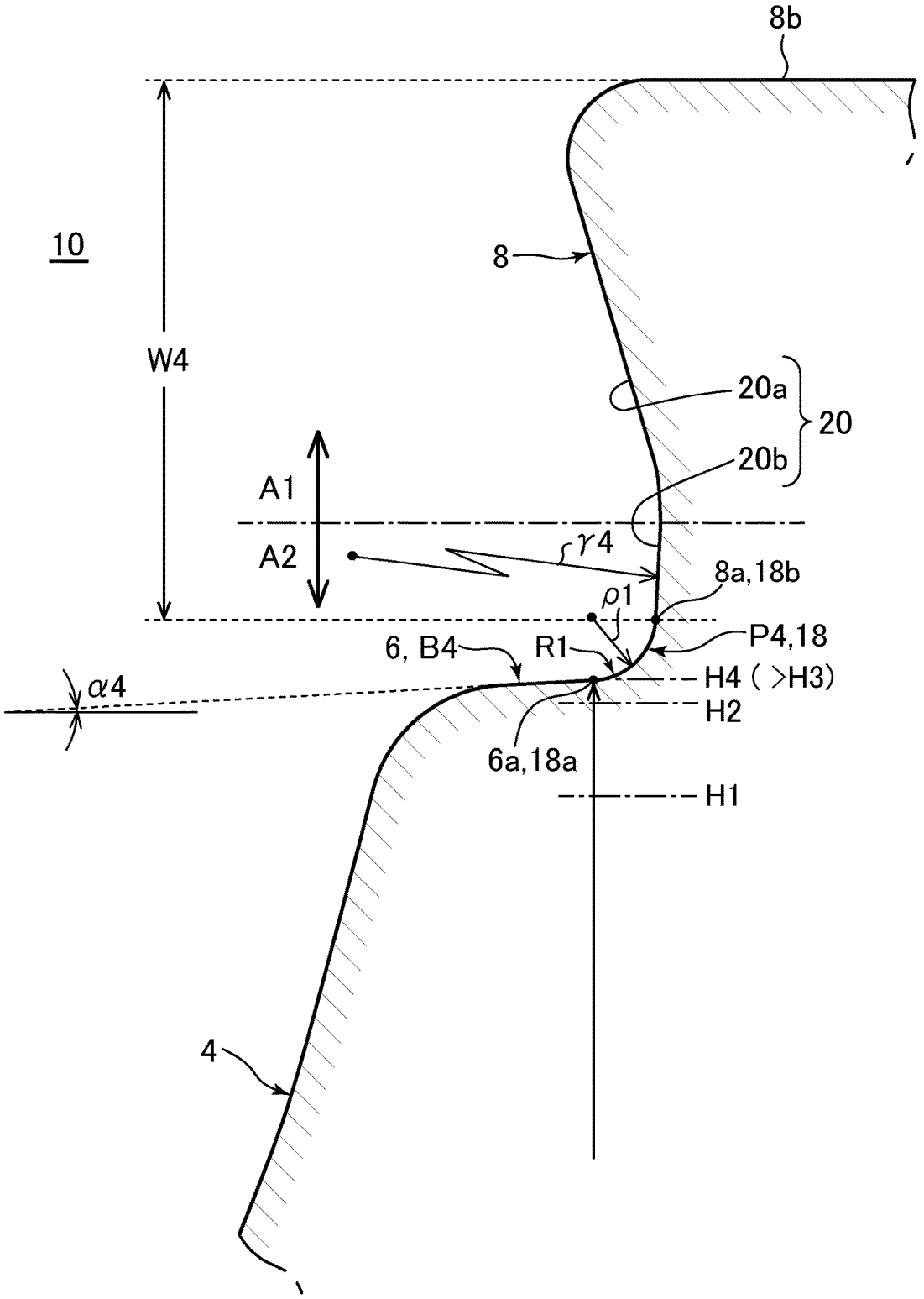
FIG. 7 is a cross section through line D-D in FIG. 2.

In addition, FIG. 7 is a cross section through line D-D in FIG. 2, and is a cross section of the front left region of the bowl 10 which is offset by 90° in the right circumferential direction about a center O of the bowl 10 from the cross section through line A-A in the toilet main unit 2 seen in plan view as shown in FIG. 2.

Here, in the present embodiment, the cross sections of the front right region of the bowl 10 rotated in the left circumferential direction by 30°, 60°, and 90°, respectively above the center O of the bowl 10 from the cross section through line A-A in the toilet main unit 2 as seen in plan view in FIG. 2 are respectively left-right symmetrical to the cross sections of the front left region of the bowl 10 shown in FIGS. 5-7, so an explanation thereof is here omitted.

First, as shown in FIGS. 4-7, the bowl 10 includes a connecting surface 18 connecting between the outside edge 6*a* of the shelf 6 and the bottom end 8*a* of the rim 8 by a curved surface R1. This connecting surface 18 is arranged so that the vertical curvature radius ρ1 of its cross section R1 as seen in elevation is essentially constant from the front portion of the bowl 10 across to its left and right sides. This enables flush water to be smoothly circulated without the flush water flowing over the shelf 6 of the bowl 10 expanding to the rim 8 side.

Note that the phrase "essentially constant" with respect to the curvature radius ρ1 includes not only the meaning of completely constant, but also approximately constant, whereby flush water flowing over the shelf 6 of the bowl 10 can be smoothly circulated without the flush water flowing over the shelf 6 of the bowl 10 expanding to the rim 8 side.

Here the vertical curvature radius ρ1 of the connecting surface 18 curved surface R1 is preferably arranged to be essentially constant at 3 mm-15 mm, and more preferably at 5 mm-10 mm.

In FIGS. 4-7, the respective heights H1-H4 of the connecting surface 18 bottom ends 18*a* matching the outside edge 6*a* of the shelf 6 rise as the position moves from the front portion of the bowl 10 toward the left and right sides (H1<H2<H3<H4), therefore the connecting surface 18 is arranged to be at height positions P1-P4, which rise as the position moves from the front portion of the bowl 10 toward the left and right sides of the bowl.

Next, as shown in FIGS. 4-7, the rim 8 forms a rising wall surface 20 whereby its inside perimeter surface rises.

As shown in FIGS. 4-7, the rising wall surface 20 heights W1-W4 correspond to the heights from the bottom end 8*a* of the rim 8 matching the top end portion 18*b* of the connecting surface 18 to the top surface 8*b* of the rim 8. Also, the rising wall surface 20 heights W1-W4 are arranged to increase in height as the position moves from the left and right sides of the bowl 10 toward the front (W1>W2>W3>W4).

Here the height W1 of the rising wall surface 20 shown in FIG. 4 is, for example, preferably set at 30 mm-85 mm, and more preferably at 50 mm-75 mm.

The height W2 of the rising wall surface 20 shown in FIG. 5 is, for example, preferably set at 28.5 mm-82 mm, and more preferably at 48.5 mm-72 mm.

In addition, the height W3 of the rising wall surface 20 shown in FIG. 6 is, for example, preferably set at 26.5 mm-78 mm, and more preferably at 46.5 mm-68 mm.

The height W4 of the rising wall surface 20 shown in FIG. 7 is, for example, preferably set at 25 mm-75 mm, and more preferably at 45 mm-65 mm.

Next, as shown in FIGS. 4-7, the rising wall surface 20 includes an upper rising wall surface 20*a* and a rising wall surface 20 respectively forming an upper area A1 and lower area A2 on the inside perimeter surface of the rim 8. Also, the vertical curvature radii γ1-γ4 as seen in elevation of the lower rising wall surface 20*b* are arranged to diminish in size as the position moves from the left and right sides of the bowl 10 toward the front (γ1<γ2<γ3<γ4).

Here, the vertical curvature radius γ1 of the lower rising wall surface 20*b* shown in FIG. 4 is, for example, preferably set to 30 mm-300 mm, and more preferably from 80 mm-120 mm.

Also, the vertical curvature radius γ2 of the lower rising wall surface 20*b* shown in FIG. 5 is, for example, preferably set to 40 mm-400 mm, and more preferably from 100 mm-140 mm.

In addition, the vertical curvature radius γ3 of the lower rising wall surface 20*b* shown in FIG. 6 is, for example, preferably set to 50 mm-500 mm, and more preferably from 120 mm-160 mm.

Also, the vertical curvature radius γ4 of the lower rising wall surface 20*b* shown in FIG. 7 is, for example, preferably set to 300 mm or greater, and more preferably from 300 mm-3000 mm.

Note that the form of the flush toilet 1 of the present embodiment shown in FIGS. 4-7 is one in which the upper rising wall surface 20*a* slopes toward the inside of the bowl 10 from the bottom end thereof (the top end of the lower rising wall surface 20*b*) upward. Without limit to such forms, however, the upper rising wall surface may slope toward the outside of the bowl 10, or the upper rising wall surface may rise in the vertical direction.

Next, as shown in FIG. 1 and FIGS. 4-7, the shelf 6 includes sloped surfaces B1-B4, sloping downward from the outside toward the inside within the bowl 10. The slope angles α1-α4 of these sloped surfaces B1-B4 are arranged to increase as the position moves from the left and right sides of the bowl 10 toward the front of the bowl (α1>α2>α3>α4).

Here, the slope angle α1 of the sloped surface B1 shown in FIG. 4 is preferably set, for example, to 5°-35°, and more preferably to 10°-20°.

The slope angle α2 of the sloped surface B2 shown in FIG. 5 is, for example, preferably set to 3.5°-30°, and more preferably to 8°-15°.

In addition, the slope angle α3 of the sloped surface B3 shown in FIG. 6 is, for example, preferably set to 2.5°-20°, and more preferably to 5°-10°.

The slope angle α4 of the sloped surface B4 shown in FIG. 7 is, for example, preferably set to 1° to 10°, and more preferably to 2°-7°.

Also, in the present embodiment, as shown in FIGS. 2 and 3, in the right side region R and the rear region B within the bowl 10, the inside perimeter wall (rising wall surface 20) formed on the downstream side of the rim spout port 14 includes a curved portion 22. This curved portion 22 forms a curved surface in which the curvature (1/r) changes from small to large (i.e., the curvature radius r changes from large to small) in proportion to the distance from the rim spout port 14 toward the downstream side in the circumferential direction as seen in the plan view shown in FIG. 2.

I.e., the shape of the curved surface of curved portion 22 seen in plan view in FIG. 2 is formed by a gradual curve C1 such as a clothoid curve whereby the curvature (1/r) thereof changes at a constant rate from small to large (put another way, the curvature radius r changes from large to small at a constant percentage).

Note that when flush water in the rear area B within the bowl 10, where waste is believed to adheres easily and flushing is difficult, it is acceptable to arrange for a non-gradual curve with respect to the curved surface shape of the curved portion 22 as seen in plan view in FIG. 2. It is also acceptable to further increase flushing performance in the rear area B within the bowl by forming a flow whereby flush water spouted from the rim spout port 14 drops into the rear area B within the bowl 10 using a curved portion to form such a non-gradual curve.

Next the operation of the flush toilet 1 according to the above-described first embodiment of the invention is explained as follows.

First, using the flush toilet 1 according to the first embodiment of the invention, flush water spouted from the rim spout port 14 forms a flow (circulating flow) which is guided in the circumferential direction of the bowl 10 by flowing over the shelf 6. When so doing, the vertical curvature radius ρ1 of the connecting surface 18 as seen in vertical elevation of the curved surface R1, which connects between the outside edge 6*a* of the shelf 6 of the bowl 10 and the bottom end 8*a* of the rim 8 with a curved surface R1, is arranged to be essentially constant from the front portion across the left and right sides of the bowl 10. At the same time, it is arranged at height positions P1-P2 which rise as the position moves from the front portion of the bowl 10 to the left and right sides of the bowl 10. These enable a connection to be made between the outside edge 6*a* of the shelf 6 of the bowl 10 and the bottom end 8*a* of the rim 8 using a relatively small curvature radius ρ1 from the front portion of the bowl across the left and right sides thereof.

Hence flush water flowing over the shelf 6 of the bowl 10 is less prone to expand on the rim 8 side, and flush water can be made to circulate smoothly. Flush water can thus be constrained from splashing outside the bowl 10. Or, flush water can be constrained from dropping onto the inside of the bowl 10 without sufficiently circulating.

At the front of the bowl 10, where urine is prone to strike, for example, it can be prevented from running up the inside perimeter surface of the rim 8 from the connecting surface 18 and splashing outside the bowl 10 even if the urine strikes the connecting surface 18 of the bowl 10, etc.

Next, using a flush toilet 1 according the present embodiment, a rising wall surface 20 in which the inside perimeter surface of the rim 8 rises is formed, and is arranged to rise in height as the heights W1-W4 (see FIGS. 4-7) of this rising wall surface 20 move from the left and right sides of the bowl 10 to the front thereof (W1>W2>W3>W4). By this means, flush water flowing over the shelf 6 of the bowl 10 is even less prone to expand on the rim 8 side, and flush water can be made to circulate more smoothly.

Also, at the front of the bowl 10, where urine is particularly prone to strike, the height W1 of the rising wall surface 20 is arranged to be high. Therefore urine can be effectively constrained from running up the rising wall surface 20 at the front of the bowl 10 and splashing outside the bowl 10.

Also, in a flush toilet 1 according the present embodiment, the rising wall surface 20 includes an upper rising wall surface 20*a* and a lower rising wall surface 20*b* which respectively form an upper area A1 and lower area A2 on the inside perimeter surface of the rim 8. Also, the vertical curvature radii γ1-γ4 (see FIGS. 4-7) of the lower rising wall surface 20*b* are arranged to diminish in size as the position moves from the left and right sides of the bowl 10 toward the front (γ1<γ2<γ3<γ4). Flush water flowing over the shelf 6 of the bowl 10 is thus even less prone to expand on the rim 8 side, and flush water can be made to circulate more smoothly.

Also, the vertical curvature radius ρ1 of the lower rising wall surface 20*b* of the rising wall surface 20 is arranged to diminish at the front of the bowl 10, where urine is particularly prone to strike. Urine can therefore be constrained from running from the lower rising wall surface 20*b* of the rising wall surface 20 at the front of the bowl 10 up the upper rising wall surface 20*a* and splashing outside the bowl.

In addition, using the flush toilet 1 of the present embodiment, the shelf 6 includes sloped surfaces B1-B4 sloping downward from the outside toward the inside on the interior of the bowl 10. Also, the slope angles α1-α4 of these sloped surfaces B1-B4 are arranged to increase as the position moves from the left and right sides of the bowl 10 toward the front of the bowl 10 (α1>α2>α3>α4). Flush water flowing over the shelf 6 of the bowl 10 is thus even less prone to expand on the rim 8 side, and flush water can be made to circulate more smoothly.

Also, the slope angle α1 of the sloped surface B1 of the shelf 6 is arranged to increase at the front of the bowl 10 where urine is particularly prone to strike. Urine can thus be made to flow down the inside of the bowl 10 without allowing it to accumulate on the shelf 6. For this reason, urine can be even more effectively constrained from running up the rising wall surface 20 at the front of the bowl 10 and splashing outside the bowl 10.

Next, referring to FIGS. 8-14, a flush toilet according to a second embodiment of the invention is explained as follows.

Figure 8:
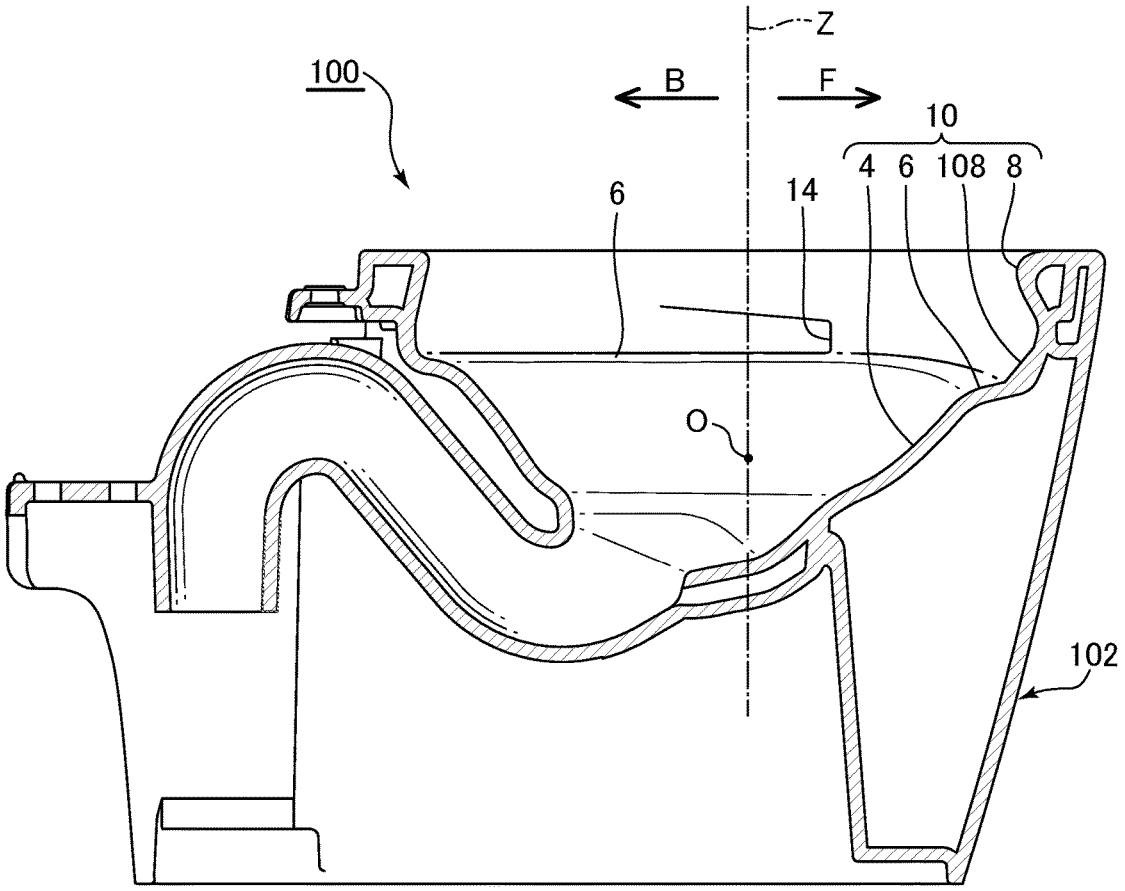
FIG. 8 is a center cross section of the main unit of a flush toilet according to a second embodiment of the invention.
Figure 9:
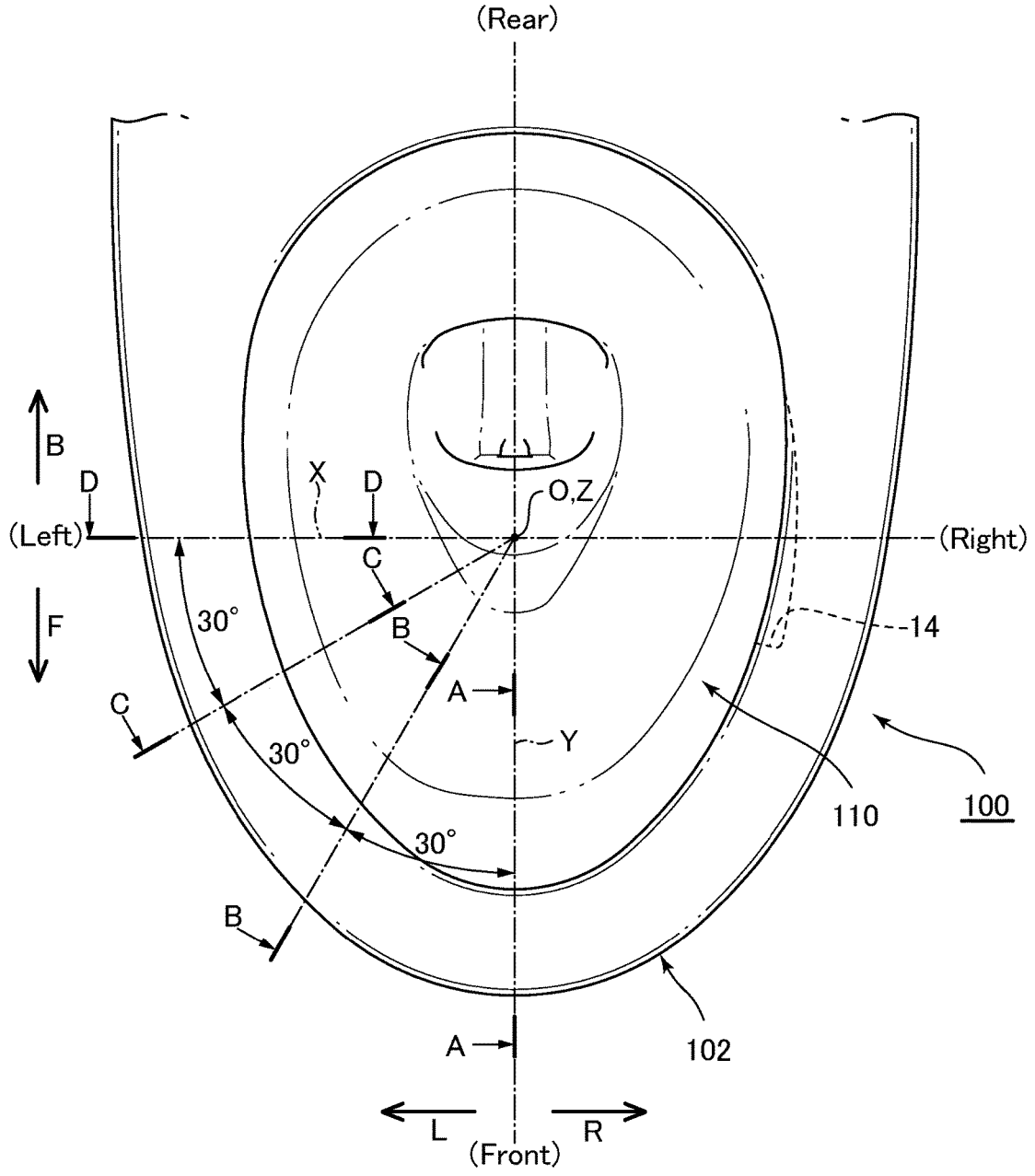
FIG. 9 is a plan view of the main unit of the flush toilet according to the second embodiment of the invention.
Figure 10:
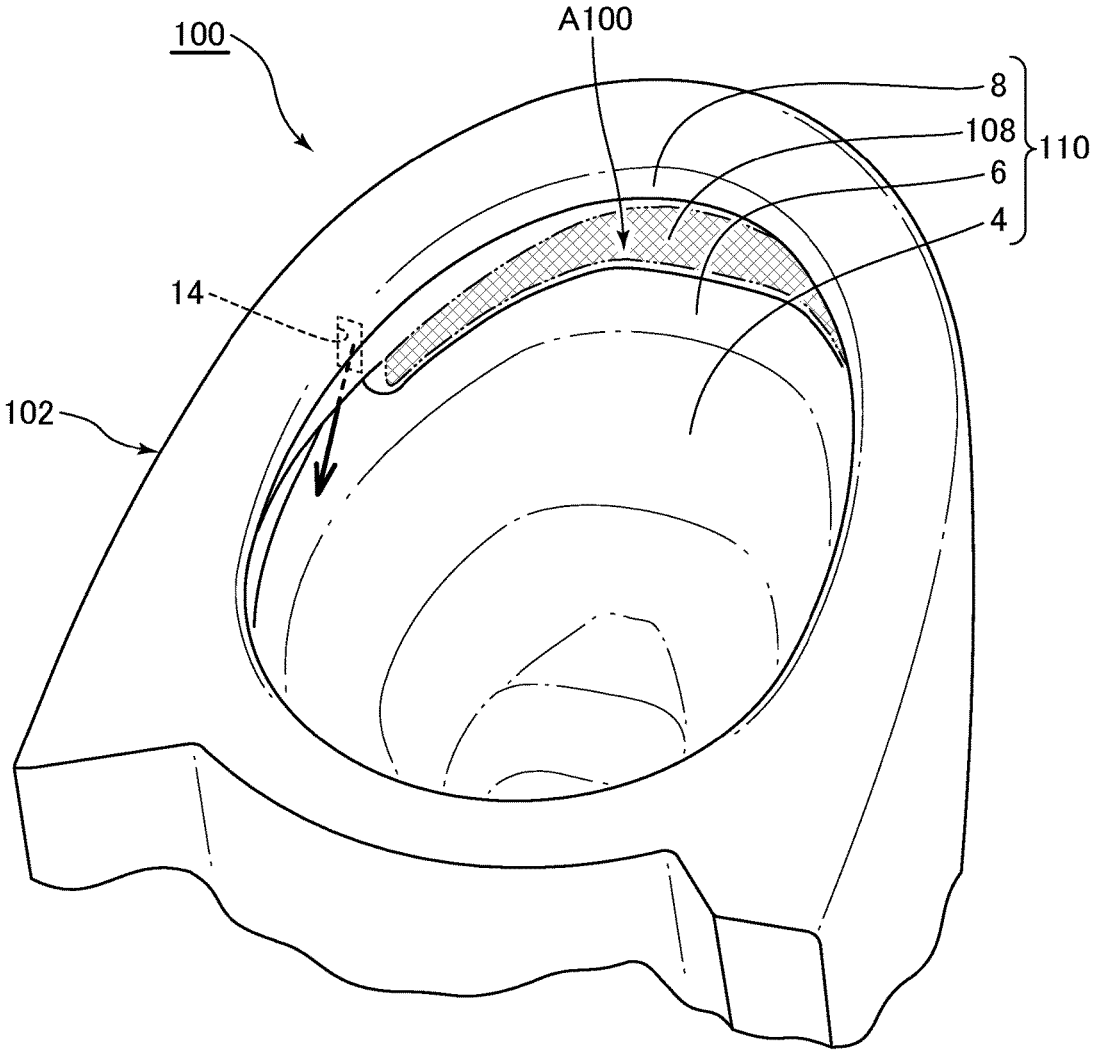
FIG. 10 is a perspective view seen diagonally from the rear of the flush toilet main unit of the flush toilet according to the second embodiment of the invention.

FIG. 8 is a center cross section of the main unit of a flush toilet according to a second embodiment of the invention. Also, FIG. 9 is a plan view of the main unit of the flush toilet according to the second embodiment of the invention. In addition, FIG. 10 is a perspective view seen diagonally from the rear of a flush toilet main unit of the flush toilet according to the second embodiment of the invention.

Figure 11:
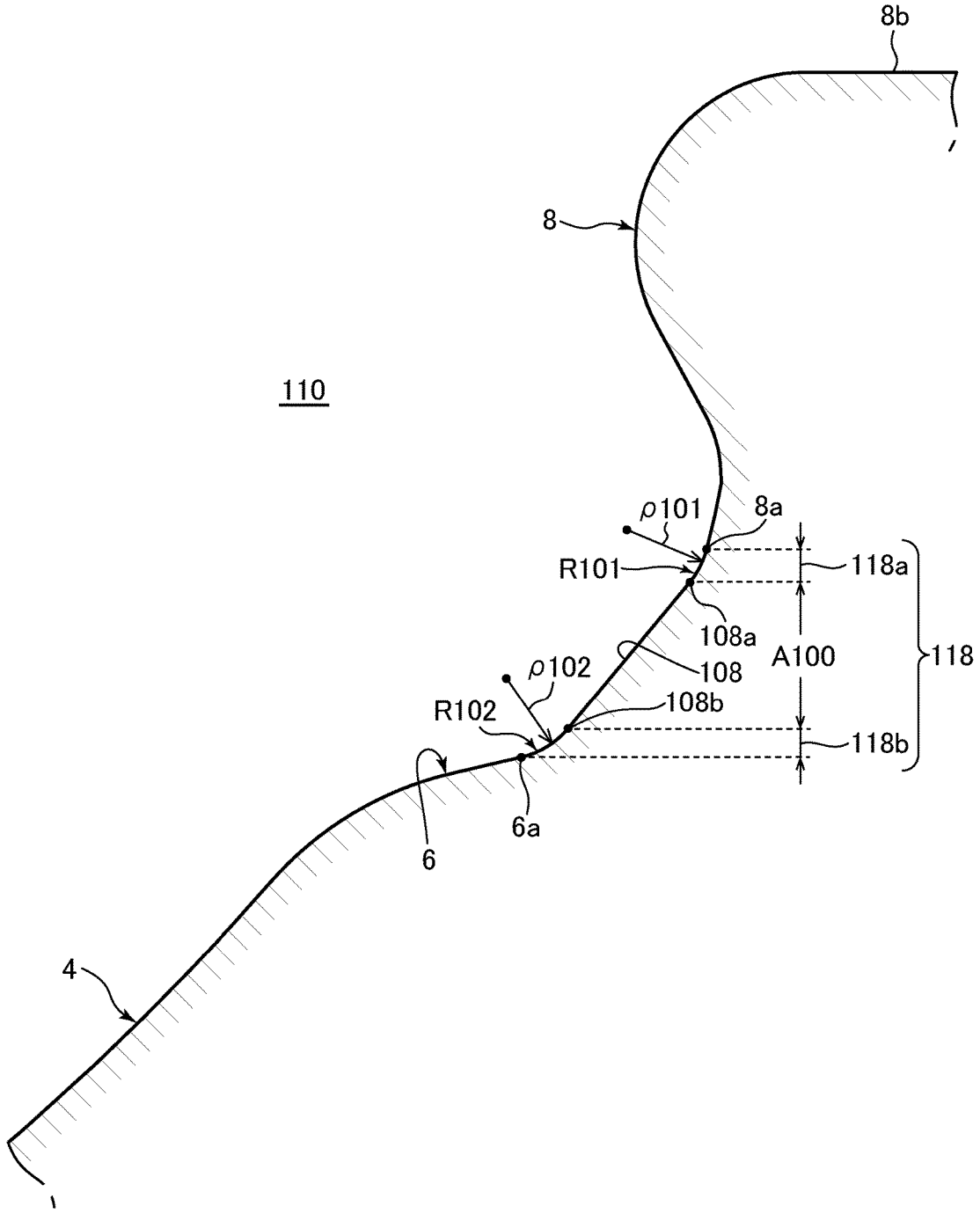
FIG. 11 is a cross section through line A-A in FIG. 9.
Figure 12:
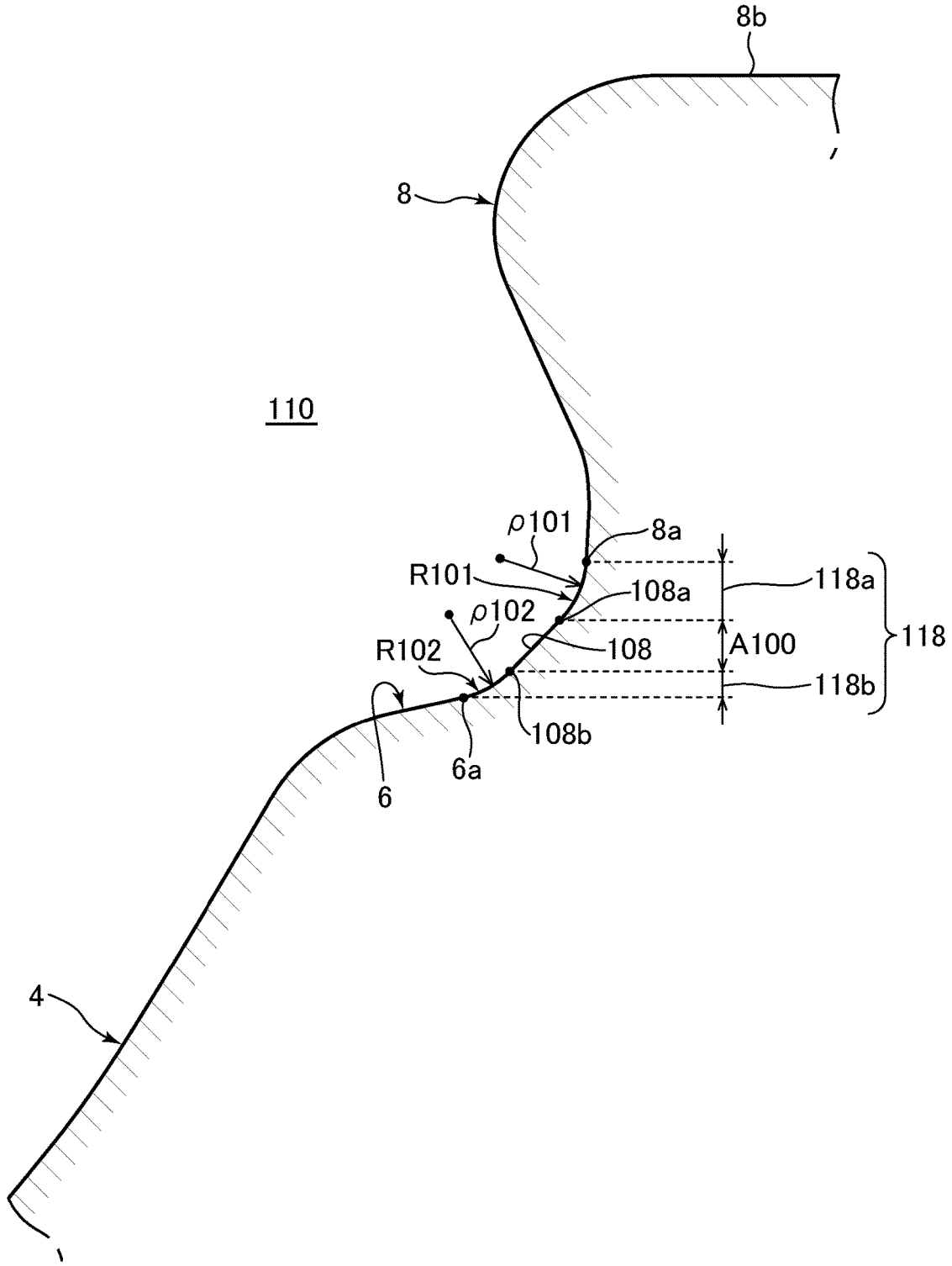
FIG. 12 is a cross section through line B-B in FIG. 9.
Figure 13:
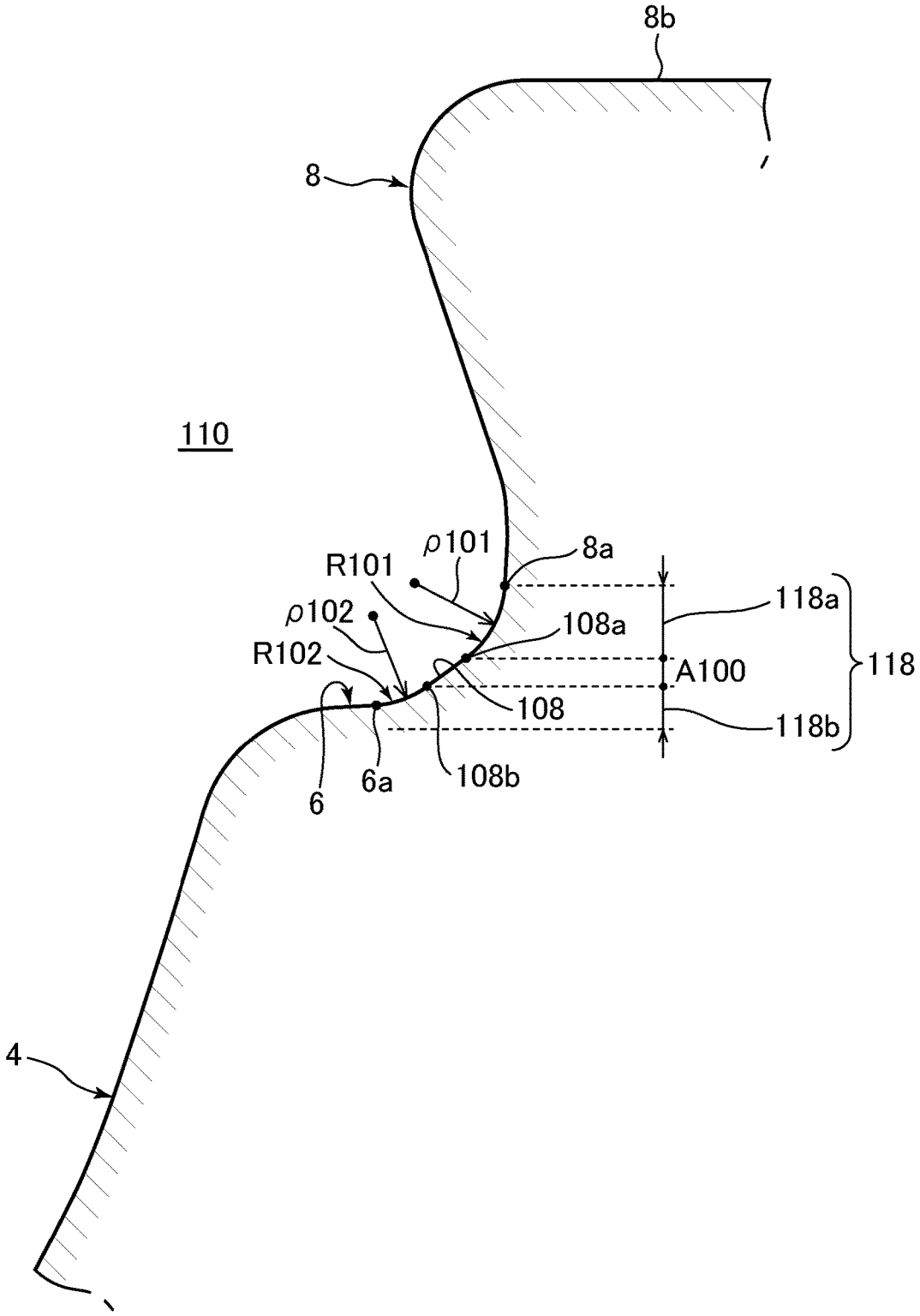
FIG. 13 is a cross section through line C-C in FIG. 9.
Figure 14:
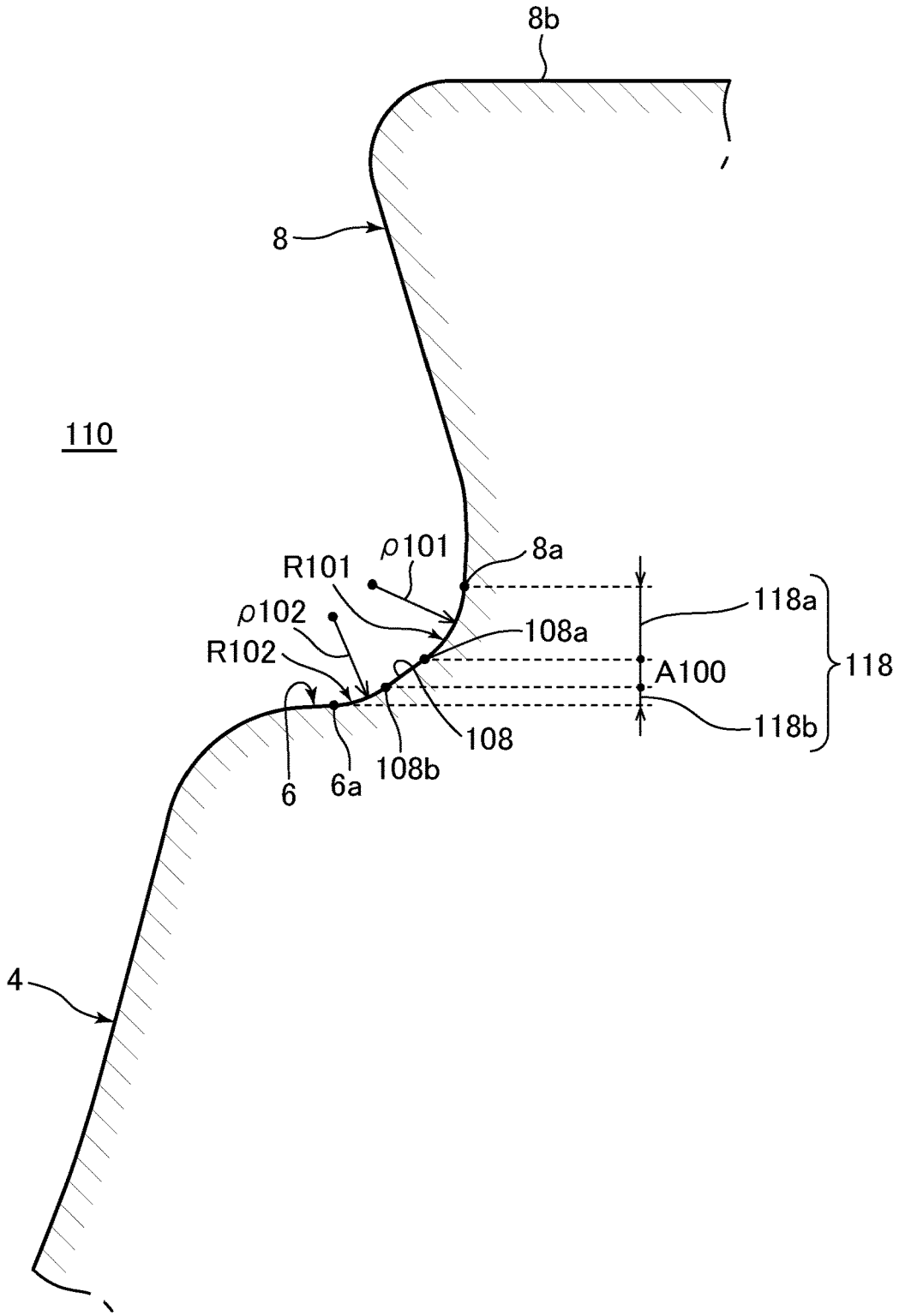
FIG. 14 is a cross section through line D-D in FIG. 9.

FIG. 11 is a cross section through line A-A in FIG. 9. Also, FIG. 12 is a cross section through line B-B in FIG. 9. In addition, FIG. 13 is a cross section through line C-C in FIG. 9, and FIG. 14 is a cross section through line D-D in FIG. 9.

Here, in a flush toilet according to the second embodiment of the invention shown in FIGS. 8-14, the same reference numerals are applied to parts identical to those in the flush toilet 1 according to the first embodiment of the invention shown in FIGS. 1-7, and an explanation thereof is here omitted.

As shown in FIGS. 8-14, the flush toilet 100 according to the second embodiment of the invention differs in structure from the flush toilet 1 according to the above-described second embodiment in that the bowl 110 includes a urine contact surface 108 between the outside edge 6*a* of the shelf 6 and the bottom end 8*a* of the rim 8.

Also, as shown in FIGS. 11-14, a connecting surface 118, connecting between the outside edge 6*a* of the shelf 6 and the bottom end 8*a* of the rim 8 with a curved surface, includes a first connecting surface 118*a* and a second connecting portion 118*b*. The first connecting surface 118*a* connects between the bottom end 8*a* of the rim 8 and the urine contact surface 108 top end portion 108*a* using a curved surface R101. The second connecting surface 118*b* connects the bottom end 108*b* of the urine contact surface 108 and the outside edge 6*a* of the shelf 6 using a curved surface R102.

Note also that the urine contact surface 108 forms a sloped surface rather than a curved surface, sloping from the bottom end 108*b* up to the top end portion 108*a* thereof.

In addition, the vertical curvature radii ρ101 and ρ102 as seen in elevation view of the respective curved surfaces R101 and R102 of the inside first connecting surface 118*a* and the second connecting surface 118*b* are arranged to be essentially constant from the front portion of the bowl 110 across the left and right sides thereof.

Here the vertical curvature radii ρ101, ρ102 of the curved surfaces R101 and R102 of the connecting surface 118 are preferably arranged to be essentially constant at 3 mm-15 mm, and more preferably at 5 mm-10 mm.

In addition, as shown in FIGS. 10-14, the urine contact surface 108 is formed in a predetermined area in the circumferential direction including the front portion of the bowl 110; i.e., in a predetermined area A100 to the front side in the circumferential direction of the rim spout port 14 in the bowl 110.

With the flush toilet 100 according to the above-described second embodiment of the invention, flush water flowing over the shelf 6 of the bowl 110 can be made less prone to swell on the rim 8 side, and flush water can be made to smoothly circulate. Along with this, a urine contact surface 108 is formed in the circumferential direction predetermined area A100, which includes the front portion of the bowl 110 where urine is particularly prone to strike. By so doing, urine can be effectively constrained from running from the circumferential direction predetermined area A100, which includes the front portion of the bowl 110 up the inside perimeter surface of the rim 8 and splashing outside the bowl 110.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing the flush toilet with flush water supplied from a flush water source, the flush toilet comprising:

a bowl which includes a rim formed at a top edge of the bowl, a bowl-shaped waste receiving surface, and a shelf formed between the bowl-shaped waste receiving surface and the rim;

a discharge path configured to discharge waste, the discharge path being connected to a bottom of the bowl; and a rim spout portion disposed on the rim, the rim spout portion being configured to spout the flush water onto the shelf in the bowl so as to form a circulating flow;

wherein the shelf is formed between a top edge of the waste receiving surface and a bottom end of the rim and in a circumferential direction from the rim spout portion, the shelf being configured to guide the flush water spouted from the rim spout portion in the circumferential direction, the bowl further includes a connecting surface configured to connect an outside edge of the shelf and the bottom end of the rim by a curved surface;

the connecting surface is configured that a curvature radius of the curved surface in the vertical direction is constant from a front portion of the bowl across both left and right sides of the bowl, and a vertical position of a lowest point of the connecting surface is raised from the front portion of the bowl to the left and right sides of the bowl;

the rim includes an inside surface, and a height of the inside surface is set to become taller as a position of the inside surface moves from the left and right sides of the bowl to the front portion of the bowl; and the inside surface includes an upper wall surface and a lower wall surface, the upper wall surface defining an upper region of the inside circumference surface of the rim, the lower wall surface defining a lower region of the inside circumference, and a curvature radius in a vertical direction of the lower wall surface is set to diminish as a position of the lower wall surface moves from the left and right side of the bowl to the front portion of the bowl.

2. The flush toilet according to claim 1, wherein the shelf includes a sloped surface configured to slope downward from an outside of an interior of the bowl toward an inside of the interior of the bowl, and a slope angle of the sloped surface is set to increase as a position of the sloped surface moves from the left and right sides of the bowl toward the front portion of the bowl.

* * * * *